United States Patent [19]

O'Hara

[11] 4,201,409

[45] May 6, 1980

[54] PORTABLE PICK-UP DEVICE

[76] Inventor: James J. O'Hara, 501 Hemlock La., Lakehurst, N.J. 08733

[21] Appl. No.: 940,971

[22] Filed: Sep. 11, 1978

[51] Int. Cl.[2] ..... A01K 29/00

[52] U.S. Cl. ..... 294/1 BA

[58] Field of Search ..... 294/1 R, 19 R, 55; 15/104.8, 257.1, 257.6

[56] References Cited

U.S. PATENT DOCUMENTS

| | | | |
|---|---|---|---|
| 3,446,525 | 5/1969 | Jones | 294/19 R |
| 3,738,697 | 6/1973 | Kahan | 294/19 R |
| 3,984,139 | 10/1976 | Battaglia | 294/19 R |
| 4,017,015 | 4/1977 | Jefferson | 294/1 R X |
| 4,032,182 | 6/1977 | D'Ath | 294/19 R |
| 4,056,278 | 11/1977 | Bau et al. | 294/19 R |
| 4,102,547 | 7/1978 | Williams | 294/1 R |

FOREIGN PATENT DOCUMENTS

| | | | |
|---|---|---|---|
| 2551114 | 5/1977 | Fed. Rep. of Germany | 15/104.8 |

*Primary Examiner*—Johnny D. Cherry

*Attorney, Agent, or Firm*—Roy C. Hopgood; John M. Calimafde; Charles W. Neill

[57] ABSTRACT

This invention provides a device by which a dog owner can conveniently pick up fecal matter deposited on the ground by his dog. The device can be operated by the dog owner without bending over and it has containers that move toward one another to pick up the fecal matter and then telescope to enclose it in a package that can be removed from the frame by which the container parts are held down on the ground and guided during the operation of the device.

13 Claims, 8 Drawing Figures

PORTABLE PICK-UP DEVICE

BACKGROUND AND SUMMARY OF THE INVENTION

There are lots of ways of picking up fecal matter dropped by a dog such as use of a shovel or hoe from which the matter picked up can be dropped into a bag; but this often leaves the dog owner with a dirty and smelly shovel or hoe which is difficult and unpleasant to clean up.

Depending upon the nature of the ground, whether hard, sandy or grassy, the shovel or hoe may push the matter along the ground instead of moving under it into a position to pick it up. This invention provides a container at the lower end of a frame by which the container can be held down on the ground, and provides also means for moving fecal matter on the ground into the container in response to the operation of a manual control at the top part of the frame. The means for moving the fecal matter is preferably a second container that moves toward the first container and that telescopes with the first container to form a package in which the fecal matter is enclosed.

If the outside of the package has become dirty from its contact on the ground, it can be dropped into a bag; and since only the parts of the package touch the fecal matter and are disposable items, there is no cleaning of the pick-up device after each operation.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
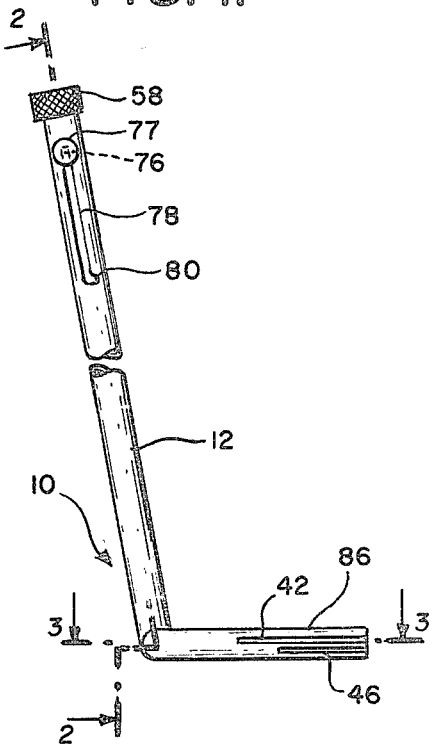
FIG. 1 is a side elevation showing the frame by which the containers of this invention are held in place and operated.

FIG. 1 shows a pick-up device 10 with an upwardly extending handle portion 12 by which the device can be conveniently held when carrying it or when in use. Guides 16 extend horizontally from the upwardly extending element 12 and parallel to each other; and these guides 16 extend along the ground when the device is in use and they serve as guides for holding containers 18 and 20 at ground level (FIG. 3) for picking up fecal matter 21 from the ground.

Figure 3:
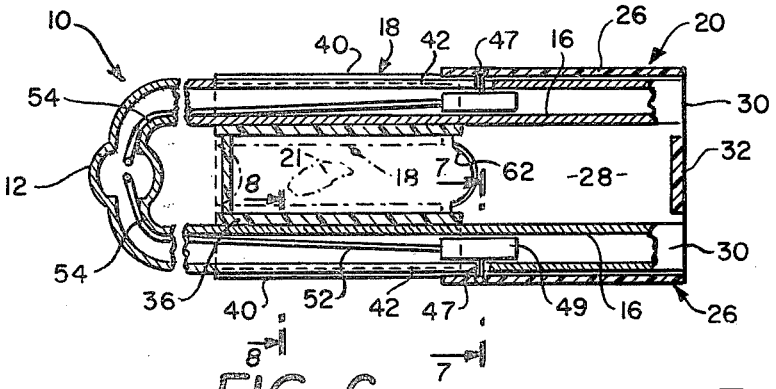
FIG. 3 is an enlarged, sectional view on the line 3—3 of FIG. 1, with the containers shown in section and positioned on horizontal guides of the device in position for starting a pick-up operation.
Figure 6:
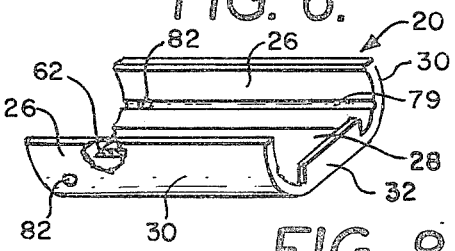
FIG. 6 is an isometric view of the right-hand container before it is mounted on the guides.

When the device is to be operated to pick up and package the fecal matter, the guides 16 are brought into position so that the matter 21, to be picked up, is between the guides 16 and under the container 18, as shown in FIG. 3. Before describing the way in which the containers 18 and 20 are correlated with the guides 16, it is necessary to understand the cross-section of the guides 16 and that of the containers 18 and 20, as shown in FIGS. 3, 4, 6 and 7.

The container 20 has a bottom 28 with side walls 26 extending from it to provide curved flanges 30, the purpose of which will be described in connection with FIG. 7. The container 20 may also have a back wall 32 which extends a short distance upward from the bottom 28 between the side walls 26.

Figure 4:
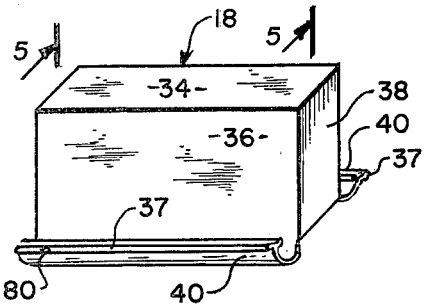
FIG. 4 is an isometric view of the left-hand container shown in FIG. 3.
Figure 5:
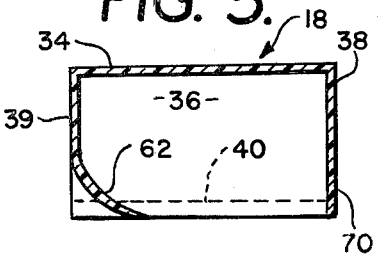
FIG. 5 is a sectional view on the line 5—5 of FIG. 4.

FIGS. 4 and 5 show the container 18 which has a top wall 34, side walls 36, a back wall 38 and a front wall 39. There are curved flanges 40 projecting outwardly from the walls 36 and curving upwardly and outwardly, the purpose of which will be described in connection with FIG. 7. A generally Tee shaped runner 37 extends lengthwise along the outside of each of the flanges 40.

Figure 7:
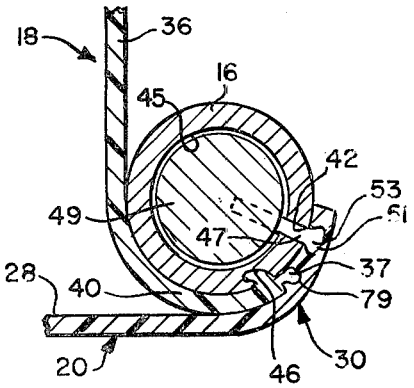
FIG. 7 is a greatly enlarged sectional view taken on the line 7—7 of FIG. 3, but with one container inserted part way into the other near the start of a pick-up operation.

FIG. 7 shows one of the guides 16 formed with a slot 42 which opens through the side of the guide 16 and into a hollow interior of the guide, this interior being designated by the reference character 45. The flange 40 of the container 18 snaps into a groove 46 in a side of the guide 16 below the slot 42. The groove 46 can extend for the full length of the guide 16 or for only a portion of the guide length.

The curved flange 30 of the side wall 26 of the container 20 is placed under the guide 16, and bends around the guide 16 to overlap the outer end of the slot 42, as shown in FIG. 7. A projection 47 is connected to a slide 49 that fits loosely in the interior of the guide 16. This projection 47 extends through and beyond the slot 42, and into an opening 51 (FIG. 7) in the side wall 26. A knob 53, on the end of the projection 47, is a snug fit in the opening 51 and thus buttons the side wall 26 to the projection 47. p The knob 53 can be disengaged from the opening 51 automatically at the end of a pick-up stroke by having the projection 47 continue its movement after the containers are fully telescoped into one another. This causes the knob 53 to come unbuttoned from the opening 51.

Referring again to FIGS. 2 and 3, a flexible cable 52 extends through the hollow interior of the guide 16 and passes around curved surfaces 54 to a vertical run of the cable 52 along the inside of the handle element 12 to a slide 56 (FIG. 2) within the handle element.

Figure 2:
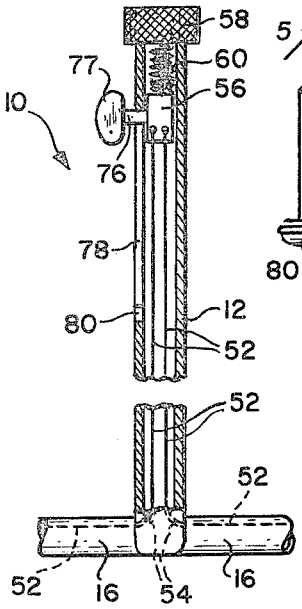
FIG. 2 is an enlarged, fragmentary, sectional view of the frame, taken on the line 2—2 of FIG. 1.

The cables 52 in both of the guides 16 connect with the slide 56, as shown in FIG. 2, or they can be connected together below the slide 56 and have a common element connecting them to the slide 56. A spring 60 is stretched between the slide 56 and an upper part 58 of the handle element. This spring maintains tension on the cables 52 and pulls the moveable container 20 (FIG. 3) along the guides 16 until a front lip 62 (FIG. 3) of container 20 passes under the matter 21 and tends to center the matter in the container 20 as a result of the shape of the lip 62 which curves or slopes rearwardly toward the center line of the container 20.

This leading edge 62 is preferably a curved chisel edge, so that it tends to dig under the fecal matter 21. The front edge 62 is originally placed under the rearward ends of the flanges 40 of the stationary container 18, as shown in FIG. 3. The front edge 62 slides under the fecal matter 21 as the moving container 20 telescopes into the container 18 until the wall 32 (FIG. 6) contacts or becomes flush with the wall 38 (FIG. 4) of container 18.

The runners 37 extend into a groove 70 (FIGS. 6 and 7) and can be used to hold the containers 18 and 20 in assembled relation with one another, since the flange 30 presses the groove 79 into engagement with the runner 37 to hold the inner flange 40 always engaged with the groove 79 of the flange 30. In the preferred construction, the containers are also latched together when they reach fully telescoped relation with one another. A projection 80 (FIGS. 4 and 8) extending outward from the surface of the runner 37 contacts with the inside surface of the curved surface 30 during telescoping of the containers 18 and 20. At the completion of a pick-up stroke, there is an opening 82 (FIGS. 6 and 8) into which the projection 80 enters to prevent further movement of the containers with respect to one another. There are other ways in which parts of the containers can engage one another; and the projection 80 and opening 82 are representative of means for locking the containers in fully engaged relation at the end of a pick-up stroke.

Referring again to FIG. 2, the slide 56 is secured to a short shaft 76 that extends through a slot 78 in a wall of the handle portion 12. A knob 77 at the outer end of the shaft 76 is used to push the slide 56 downward to tension the spring 60. The spring can be held under tension by moving the shaft 76 circumferentially into a bayonet offset 80. This leaves the cables 52 slack.

By tilting the device so that the free ends of the guides are lowermost, the slides 49 in the guides 16 slide in directions to take up any slack in the cables 52. The containers 18 and 20 are then placed on the guides 16, as shown in FIG. 3, with the ends of the flanges 30 projecting for a short distance under the flanges 40.

Figure 8:
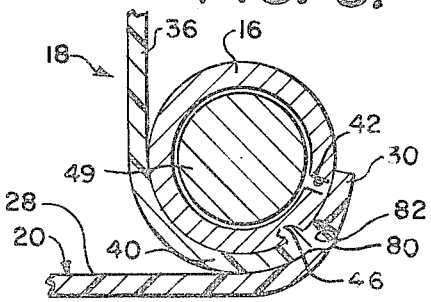
FIG. 8 is a fragmentary view of the part of the structure shown in FIG. 7 but with the parts in the positions they occupy near the end of a pick-up stroke, at the line 8—8.

When a pick-up is to be made, the device is placed on the ground with the open bottom of the container 18 located directly over the fecal matter 21. The knob 77 is shifted to the left in FIG. 1, and the spring 60 (FIG. 2) pulls the slide 56 upward. This pulls the container 20 into and under the container 18 enclosing the matter in a box formed by the containers 18 and 20 and locked together by the runners 37 and grooves 79; and by the projection 80 engaged in the opening or recess 82, as shown in FIG. 8. The box or package is disengaged from the guides 16 by pulling the flanges 30 outward to disengage them from the projections 47 and knob 53, and then pushing the assembled containers downward to disengage the flange 40 from the slot 46, or sliding the telescoped container off the ends of the guides remote from the upwardly extending element 12.

The containers 18 and 20, movable along guide means, are representative of means for moving container into a position on the ground close to fecal matter which is to be picked up, and apparatus for moving the fecal matter into the container by means of motion-transmitting means controlled from a handle at a location which does not require the operator to bend over to move the element that pushes the fecal matter into the container.

The preferred embodiment of the invention has been illustrated and described, but changes and modifications can be made and some features can be used in different combinations without departing from the invention as defined in the claims.

What is claimed is:

1. Apparatus for picking up fecal matter on the ground including in combination a frame with an upper portion that serves as a handle, a container holder at the lower end of the handle, a container, the holder being in position to hold the container with a bottom of the container facing the matter to be picked up, means for loading the matter on the ground into the container, and manually-operated motion transmitting connections on said upper portion and secured at their lower end to means for operating the apparatus, characterized by the means for loading the matter into the container including a second container with a bottom that extends along the ground and an open end facing the first container, said bottom of the second container being in position to contact with the fecal matter when the motion-transmitting connections are operated on a pick-up stroke, the movement of the motion-transmitting connections being long enough to bring the containers into contact with one another and to telescope one container into the other.

2. The apparatus described in claim 1 characterized by at least one of the containers having a flat bottom that is parallel to the surface of the ground, and one of the containers having releasable means for attaching it to the motion-transmitting connections.

3. The apparatus described in claim 1 characterized by the containers being shaped with respect to one another to form a fully closed package when telescoped together, and means on the containers in position to lock the package closed.

4. The apparatus described in claim 1 characterized by the lower part of the frame having guides for positioning the containers with one thereof substantially parallel to the ground, the means for loading the first container being the second container, the lower part of the frame also having a guide along which the second container can move toward the first container, the second container being shaped to slide along the guide and having means for connecting with the motion-transmitting connections.

5. The apparatus described in claim 4 characterized by the first container being held in position by the frame in alignment with the second container, and the containers having walls shaped to telescope one container into the other and to form a closed package which can be released from the motion-transmitting connections after the package is closed.

6. The apparatus described in claim 5 characterized by each of the containers being a throw-away container with guide flanges that contact with the frame, said frame having guides on both sides of the second container along which the flanges of the second container slide as the second container is pulled along the guides by operation of the motion-transmitting connections into a position that telescopes the second container and the first container into a closed package with their flanges extending adjacent to one another and holding the package closed for disposal.

7. The apparatus described in claim 4 characterized by each of the containers being shaped to telescope into the other and one of the containers having its bottom side substantially flat and parallel to the ground and in contact with the ground, and lower than any other part of the frame when assembled with the frame, and having a sharp edge for engaging under the fecal matter that is to be picked up off the ground, the fecal matter being carried into the first container by said second container to complete a package.

8. Apparatus for picking up fecal matter on the ground including in combination a frame with an upper portion that serves as a handle, a container holder at the lower end of the handle, a container, the holder being in position to hold the container with a bottom of the container facing the matter to be picked up, means for loading the matter on the ground into the container, and manually-operated motion transmitting connections on said upper portion and secured at their lower end to means for operating the apparatus, characterized by two containers, the frame having two parallel guide elements attached to and forming a part of the frame with one of the guide elements on each side of each of the containers, both of the guide elements having openings that extend lengthwise thereof, both of the containers having flanges that extend lengthwise of the containers and that are guided by said openings for mounting the containers on the guide elements.

9. The apparatus described in claim 8 characterized by a longitudinally extending opening in each of the guide elements in position to receive the flanges of the first container, the flanges of the second container extending under the guide elements and under the flanges of the first container so that the second container bottom that is in contact with the ground is at a level lower than the first container flanges and the bottoms of said guide elements.

10. The apparatus described in claim 9 characterized by the motion-transmitting connections comprising flexible tension elements extending along hollow interiors of the guide elements and with elements at the ends of the connections for engaging into openings in the second container, the flexible element in each of the guide elements extending along said guide elements and around curved structure that changes the direction of movement of the flexible element, said flexible element then extending upward from each of the guide elements to the portion of the frame that serves as a handle and both of the flexible elements being connected with a single operating device that pulls the flexible elements by the same displacement as one another to move the second container along the ground, and the second container having a front edge shaped to engage under fecal matter on the ground to scoop said matter into the second container and to carry said matter into the first container.

11. The apparatus described in claim 10 characterized by each of the guide elements having a hollow interior and having a slot providing access to the hollow interior, the slot in each guide element being on the side that faces away from the other guide element, the slot being of a width narrower than the height of the hollow interior of the guide element and communicating with the upper part of the hollow interior so that the lower part of the hollow interior provides a depression in which the connectors and flexible tension element slide, the tension element including a spring extending upward in a handle portion of the apparatus, an opening in the handle portion for putting the tension element under tension that moves the second container into the first container as said tension is released, a manually-operated device on the handle for tensioning the spring, and means for holding the spring tensioned, said means for holding the spring tensioned being manually releasable to operate the apparatus.

12. The apparatus described in claim 11 characterized by a slide in the handle portion for connecting the spring with the tension elements, a manually-operated shaft connected with the slide and extending through a slot to the outside of the handle portion and movable downward along the slot to tension the spring, the slot having a bayonet off-set at its lower end for holding the shaft against upward movement when engaged in the bayonet off-set, the shaft having angular movement about the axis of the handle portion for engaging it and disengaging it from the bayonet off-set.

13. The apparatus described in claim 9 characterized by each flexible element being a cord with a guide at its lower end for movement along the inside of one of the guide elements, and a connector on the guide extending through a longitudinal slot in the side of the guide element and through an opening in the flanges of the second container for advancing the flanges of the second container along the guide elements when the apparatus is performing a pick-up operation, and a retainer on the end of the connector remote from the container flange and that moves along the inside of the guide element.

* * * * *